US008586168B2

(12) United States Patent
Azzar

(10) Patent No.: US 8,586,168 B2
(45) Date of Patent: Nov. 19, 2013

(54) SIDE NOTCH PAPER

(75) Inventor: James D. Azzar, East Grand Rapids, MI (US)

(73) Assignee: ABO Consulting, LLC, Kingbury, NV (US)

( * ) Notice: Subject to any disclaimer, the term of this patent is extended or adjusted under 35 U.S.C. 154(b) by 450 days.

(21) Appl. No.: 12/832,443

(22) Filed: Jul. 8, 2010

(65) Prior Publication Data

US 2012/0009384 A1 Jan. 12, 2012

(51) Int. Cl.
*B32B 3/24* (2006.01)

(52) U.S. Cl.
USPC ..... 428/136; 271/1

(58) Field of Classification Search
USPC ..... 428/136; 271/1
See application file for complete search history.

(56) References Cited

U.S. PATENT DOCUMENTS

| | | | | |
|---|---|---|---|---|
| 3,698,602 | A | | 10/1972 | Gnage |
| 4,768,325 | A | | 9/1988 | Lindee et al. |
| 4,938,656 | A | | 7/1990 | Gamberini et al. |
| 5,137,172 | A | | 8/1992 | Wagner et al. |
| 5,826,870 | A | * | 10/1998 | Vulgamore et al. ..... 271/1 |
| RE36,091 | E | | 2/1999 | Wagner et al. |
| 5,981,013 | A | * | 11/1999 | Russ et al. ..... 428/43 |
| 2004/0154486 | A1 | | 8/2004 | Mitchell, Jr. |

* cited by examiner

*Primary Examiner* — William P Watkins, III
(74) *Attorney, Agent, or Firm* — Sughrue Mion, PLLC

(57) ABSTRACT

A sheet-form paper for separating portions produced by a portion control machine and dispensing from a paper feed system, each sheet of the sheet-form paper including a recess formed in at a side edge for receiving a male guide, and a slit extending inwardly from an edge of the recess for engaging a knife edge of the male guide. The slit extends from an innermost edge of the recess substantially perpendicular to the side edges of the sheet.

7 Claims, 5 Drawing Sheets

SIDE NOTCH PAPER

FIELD OF THE INVENTION

This invention generally relates to the art of sheet-form paper and, particularly, sheet-form paper particularly adapted for separating portions produced by a portion control machine, along with a method of fabricating a sheet of paper for such applications.

BACKGROUND OF THE INVENTION

Various machines are used to produce portions in a portion control apparatus. In some of these portion control machines, sheet-form paper is used for separating the portions. These sheets are often dispensed from a paper feed system, which feeds the bottom-most sheet of paper from a vertical stack of individual sheets.

One type of portion control machine forms patties of material, such as ground meat. Originally, the patties were formed by hand but this involves human contact, which can involve unsanitary conditions, as well as a lack of uniformity in the weight, size and shape of the patties, and limitations on worker output.

Portion control machines for forming patties can overcame many of these short comings by producing patties in a sanitary manner that are substantially uniform in size, shape, and weight and can also result in a significant increase in per worker output.

A patty making machine typically includes a mechanism to dispense sheets of paper to be contacted with the patty to ensure separation of the patty from other patties or surfaces. These sheets prevent "sticking" between patties or portions thereof. The most commonly used type of sheet is made of paper coated with wax. Some dispensing mechanisms use rolls of paper that are cut or torn to a desired length. However, these rolls must be continuously replaced, which results in shut-down time for the patty making machine and interruption of the patty making process.

Other paper dispensing mechanisms utilize precut sheets of paper that have one or more holes in the paper. These sheets are stacked with the holes aligned and fitting over rods or pins from which the paper is torn during dispensing. However, requiring the rods to be threaded through the holes increases the difficulty in loading the paper. Further, cutting or tearing the paper can result in small fragments of paper being deposited upon the patty. The disadvantages associated with precut sheets of paper having holes to facilitate stacking the sheets has led to the use of a system wherein the sheets are provided with deformable elements, such as notches in the side edges of the sheets.

U.S. Pat. No. 5,137,172 shows a paper feed system suitable for use with a patty making machine to provide paper for separating the patties. A vertical stack of sheet-form paper is provided with a deformable element, such as a notch, on the side edge or edges. A paper hopper is adapted to receive and temporarily retail the stack of paper sheets and is adapted to dispense the sheets by feeding the bottom-most sheet of paper from the stack. A male guide associated with the inside surface of the paper hopper engages the deformable element on the side edge of the sheets. A proximal end of the male guide adjacent to where the paper is dispensed temporarily retains the paper sheets in such a manner that the bottom-most sheet is dispensed without tearing the paper. Essentially, the deformable elements, such as the notches, on the side edges of the sheets cause each individual sheet to be bent at an extreme angle when pulled past the male guide without tearing the paper.

Normally, the frictional force between the bottom-most sheet that is being dispensed and the next sheet in the stack is insufficient to pull the next sheet free from the guide, as it is not sufficient to overcome the "hold back" force resulting from the extreme bend required to free the paper from the guide. Accordingly, the next sheet is maintained within the paper hopper by its deformable element, and thus the paper should be dispensed only a single sheet at a time.

However, this required that the sheets be sufficiently stiff to provide adequate "hold back" force necessary to allow only a bottommost sheet to be pulled away. Nonetheless, problems still have been encountered with certain sheet-form paper stock wherein there still is a tendency to pull two sheets of paper at a time if the paper feed system is not adjusted properly. Adding a more severe bend to the deformed or notched paper to increase its "hold back" force might be considered a solution to this problem, but it has been found that there is a tendency to tear the paper if it must be deformed too severely.

Another problem with previous paper feed systems is that thinner sheets have a tendency to bow downwardly and fall out of the support means of the system. The feed mechanisms used to depose the separating sheets between the patties or portions require that the sheet be supported under two of its opposite edges. Specifically, the sheets are fed along a support means which normally includes a pair of side rails which support the two opposite side edge areas of the sheets. While supported, a patty or portion is deposited on top of a sheet which is then accelerated downward to the top of a stack below. Repeated positioning of additional sheets and subsequent depositing of the portions forms a stack of interleafed patties Previously, thinner sheets, on the order of 0.002 inches thick could not be used because they had a tendency to fall down between the side support rails due to their own weight, even before a portion is deposited on the sheet. Therefore, "stiffer" interleaf sheets which would remain in position and did not fall out of the support rails during stacking were used.

An alternative solution was to provide a means for stiffening the sheets so that they do not fall through the support means, particularly providing a sheet without adding significant cost. In addition, the stiffening means can be used to reinforce deformable elements or notches at the side edges of the sheets to increase the "hold back" forces necessary to allow a bottommost sheet to be pulled away from the next sheet in a stack thereof.

However, these notches only provided improved support at the front and back portions of the sheet and did not provide improved support at the sides. As the paper was pulled forward, the paper would sag at the center and pull away from the sides, limiting the through put of the patty portion control machine and requiring the use of thicker, less flexible sheets.

Therefore, there remains a need for improved sheet-form paper that allows for thinner sheets without the inherent problems discussed above encountered when decreasing the thickness of the sheets.

SUMMARY OF INVENTION

An aspect of the present application is to provide a new and improved sheet-form paper for separating portions produced by a portion control machine.

A further aspect of the present application is to provide such sheet form paper particularly adapted to be dispensed from a paper feed system that feeds the bottom-most sheet of paper from a vertical stack of individual sheets of paper.

In an exemplary embodiment, the bottom-most sheet of paper from the vertical stack thereof is adapted to be fed along a support means, such as a pair of spaced parallel support rails, which support opposite edges of the sheets. According to this exemplary embodiment, recesses are formed on opposing edges of the sheet of paper, for engaging the support means. Further, each recess comprises a slit, for engaging a knife edge from one of the support means.

An exemplary embodiment of the present invention is directed to a unique solution to the above-identified problems by providing recesses, which allow front/back support of the sheet, and slits on each recess which further allow side support of the sheet, increasing the throughput of the patty forming machine while simultaneously allowing for thinner paper.

Exemplary embodiments of the present invention may address the above identified problems. However, exemplary embodiments of the present invention need not address the above identified problems or any problems whatsoever. Other features and aspects of the invention will be apparent from the following detailed description taken in connection with the accompanying drawings.

BRIEF DESCRIPTION OF DRAWINGS

The features of the exemplary embodiment of the invention, which are believed to be novel, are set forth with particularity in the appended claims. The invention, together with its aspects and the advantages thereof, may be best understood by reference to the following description taken in conjunction with the accompanying drawings, in which like reference numerals identify like elements in the figures in which:

DETAILED DESCRIPTION OF EXEMPLARY EMBODIMENTS

It will be understood that the invention may be embodied in other specific forms without departing from the spirit or central characteristics thereof. The present examples and exemplary embodiments, therefore, are to be considered in all respects as illustrative and not restrictive, and the invention is not to be limited to the details given herein.

Figure 1:
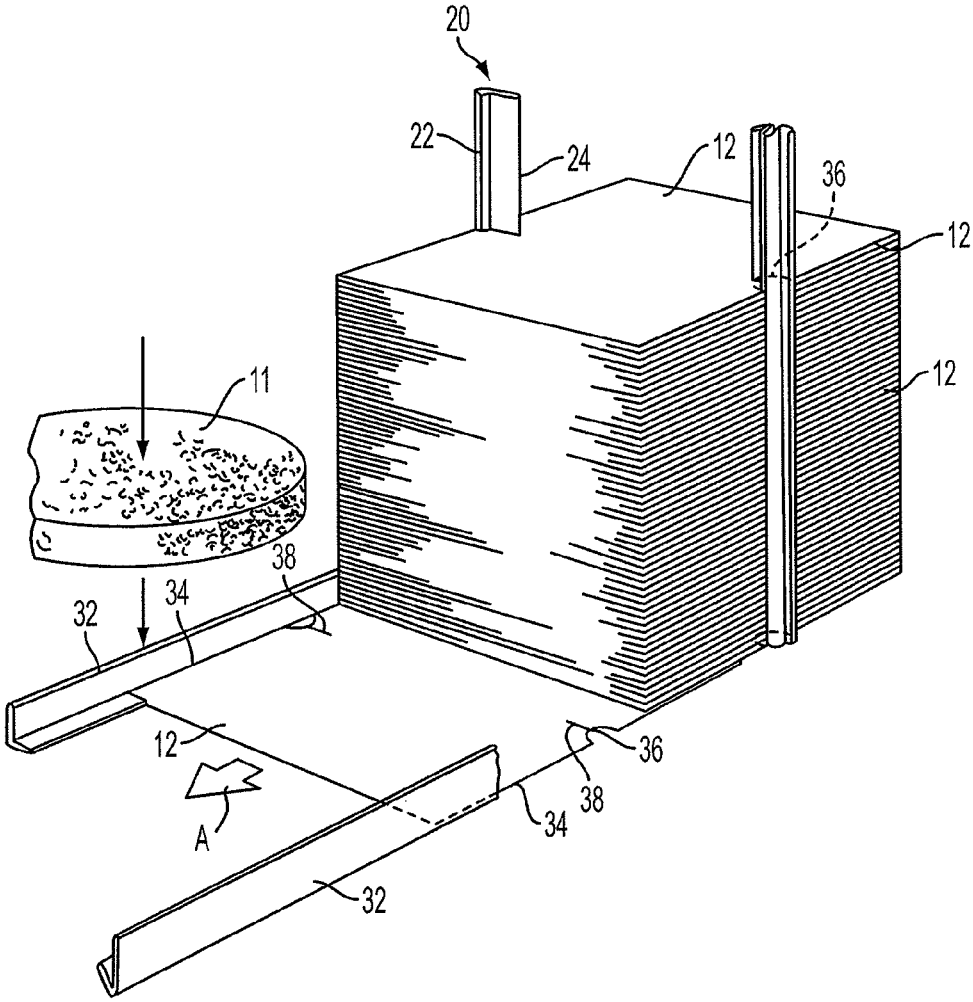
FIG. 1 is a perspective view of a paper feed system for use with the present invention.
Figure 2:
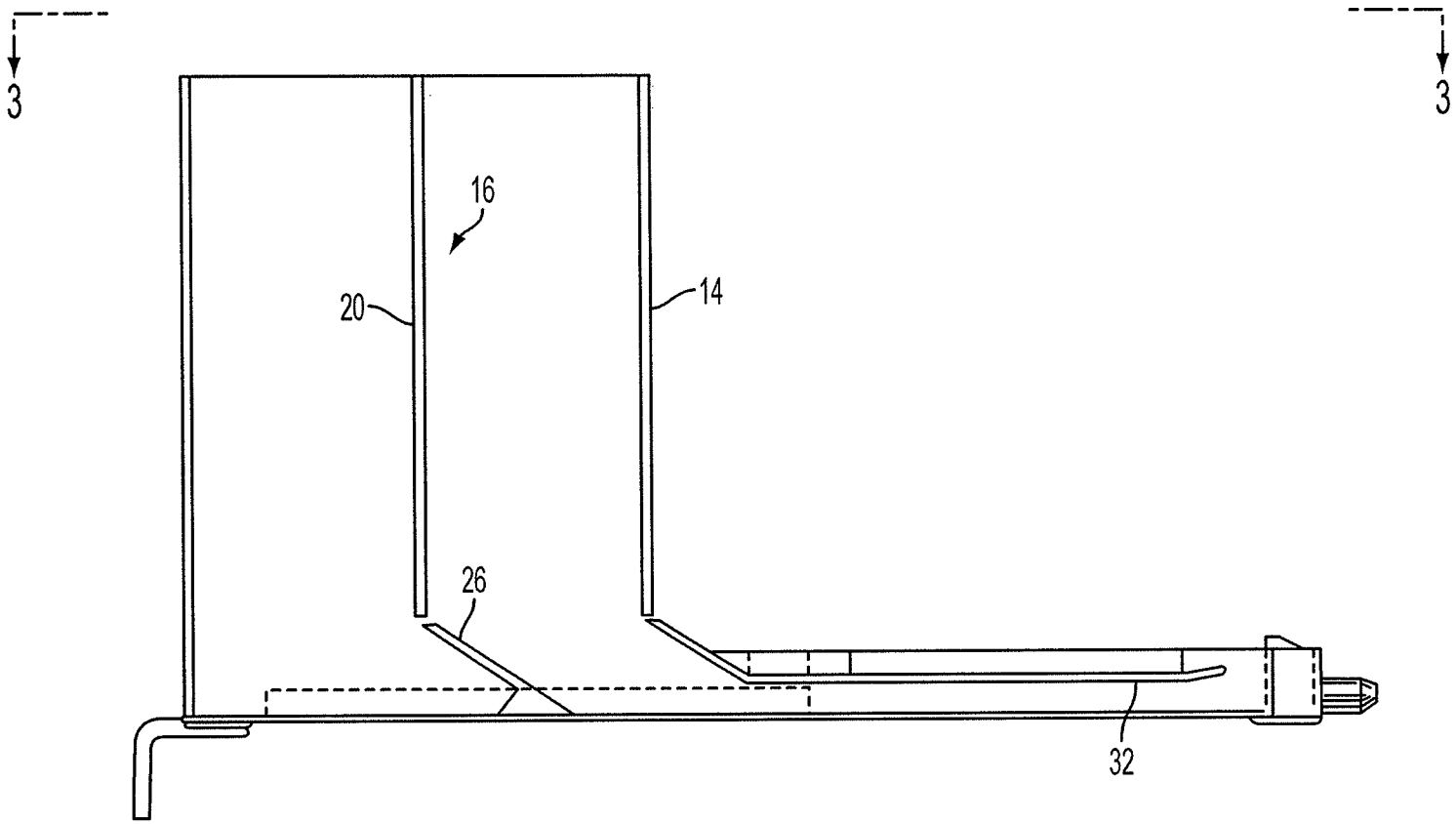
FIG. 2 is a side elevational view of the paper dispenser for use with the present invention.
Figure 3:
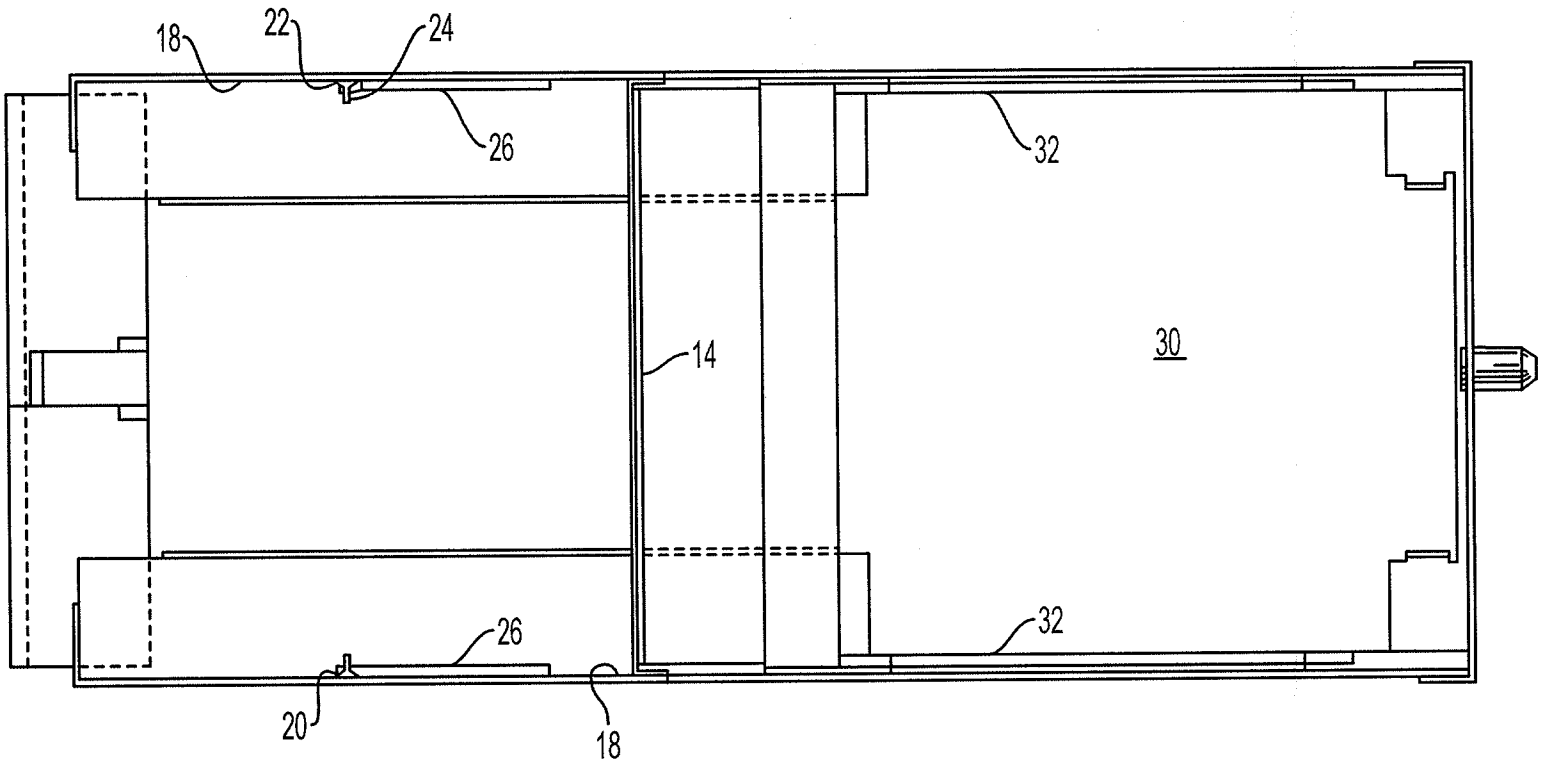
FIG. 3 is a top elevational view of the paper dispenser for use with the present invention.

FIG. 1 illustrates an exemplary embodiment of the paper feed system having a paper hopper 10 that is adapted to receive and temporarily retain the sheet-form paper 12 of the exemplary embodiment of the present invention and to dispense such sheet-form paper 12. The hopper 10 without the paper 12 is shown in FIGS. 2 and 3. The hopper 10 can be constructed to be adjustable to receive different sizes of paper 12 to adjust for different patty and/or paper sizes. The hopper 10 has a front 14 from which the paper 12 is dispensed. The front 14 can be a wall or can be defined by the front edge of the paper.

A guide 16 is associated with the interior surface 18 of each of the sidewalls of the hopper 10. The guides 16 are male elements extending from the surfaces 18 and include a first section 20 including a wide base portion 22 and a knife blade portion 24. The guide 16 has a second section 26 that is adjacent to where the paper 12 is dispensed and has a different thickness than the first section 20 of the guide 16.

The hopper 10 can be attached to a frame 28 that defines an opening 30 and includes ledges 32 extending into the opening 30 substantially along the length of the frame 28 which support paper 12 within the opening 30.

Figure 4C:
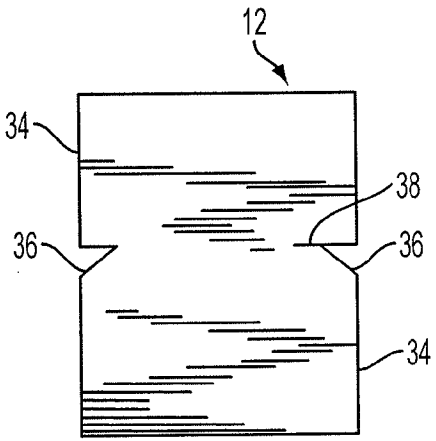
FIGS. 4A-4C are top elevational views of alternative exemplary embodiments of the sheet-form paper according to the present invention.
Figure 4B:
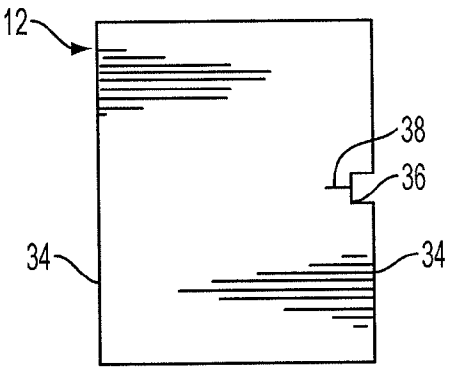
Figure 4A:
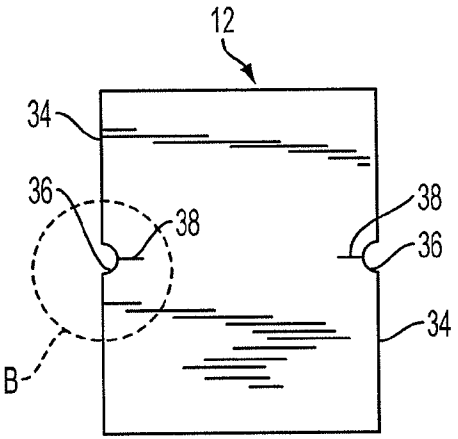
Figure 5:
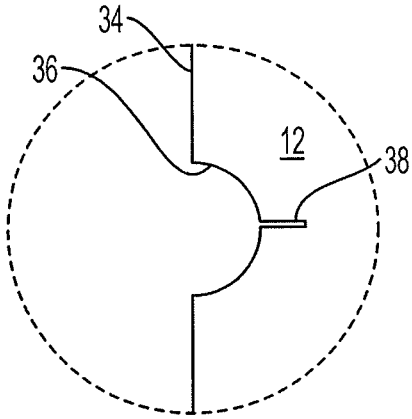
FIG. 5 is a partial enlarged view of portion B of FIG. 4A.

FIGS. 4A-4C illustrate exemplary embodiments of the sheet-form paper 12 of the present invention. FIG. 5 illustrates a partial enlarged view of a portion of FIG. 4A indicated by dashed line B.

The sheet-form paper 12 of the exemplary embodiment of the present invention is used for separating portions 11 produced by a portion control machine, such as ground meat, and for dispensing from a paper feed system that feeds a bottom-most sheet of paper from a vertical stack of individual sheets of paper in a direction indicated by arrow A in FIG. 1. The bottom-most sheet is supported by the paper feed system on opposite side edges 34 of the sheet. Each individual sheet of a stack of the sheet-form paper includes at least one recess 36 formed at an edge for receiving a wide base portion 22 of the guide 16, and a slit 38 extending inwardly from an edge of the recess 36, for engaging a knife blade portion 24 of the male guide 16.

The slit 38 extends substantially perpendicular to the side edges 34 and extends from an innermost edge of the recess 36. The recess 36 may have a rectangular shape, as shown in FIG. 4B, or alternatively may have a V-shape, as shown in FIG. 4C. The slit 38 may have a rectangular shape, as shown in FIG. 5. The recess 36 and slit 38 may extend from only one side edge 34 of the sheet 12, as shown in FIG. 4B or both side edges 34 of the sheet 12 as shown in FIG. 4A. The slit 38 may only extend from one of a plurality of recesses 36 as shown in FIG. 4C.

The lengths of the recess 36 and slit 38, and the thickness of the first guide section 20 is such the areas of the paper 12 adjacent the recess 36 and slit 38 are allowed to deform and slide over the male guide 16 quickly and easily with a minimum of frictional force therebetween until the paper 12 is adjacent to the location where the paper 12 is intended to be supported.

In the exemplary embodiment shown in FIG. 4A, one recess 36 is formed at each of the opposite side edges 34 of the sheet 12, with each recess 36 having a semicircular shape. As an example, if the sheet is a 5.0 inch square, the recess 36 may be a semicircle having a radius of 0.1 inches and the slit 38 extends inwardly approximately 0.1 inches. The slit 38 extends inwardly from and perpendicular to each of the recesses 36. The recess 36 and slit 38 formed at one of the side edges 34 has the same shape as the recess 36 and slit 38 formed at the other of the side edges 34.

In the exemplary embodiment shown in FIG. 4B, one rectangular shaped recess 36 is formed on one side edge 34 of the sheet 12.

The recess 36 provides front to back support of the sheet of paper 12 within the paper feed system, while the slit 38 provides side to side support of the sheet 12 and prevents rotation of the sheet 12 within the hopper 10. The combination of the slits 38 extending from the recesses 36 allows for more precise positioning of the sheets 12 within the hopper 10 and allows for an increased grip which allows for improved reliability. Increased reliability thereby allows for an increase in speed. The increase in speed decreases sagging between when the paper is pulled forward and when the patty is placed on the sheet. This also allows for thinner sheets while avoiding the problems encountered with thinner sheets in the conventional sheet-form paper.

It will be understood that the invention may be embodied in other specific forms without departing from the spirit or central characteristics, thereof. The present examples and exemplary embodiments, therefore, are to be considered in all respects as illustrative and not restrictive, and the invention is not to be limited to the details given herein.

What is claimed:

1. A stack of paper for separating portions produced by a portion control machine and dispensing from a paper feed system that feeds a bottom-most sheet of paper from the stack of paper, the stack of paper comprising a plurality of individual sheets of paper wherein the bottom-most sheet of paper is supported by the paper feed system on opposite side edges of the sheet of paper, each sheet of paper comprising:

a recess formed at an edge which receives a male guide of the paper feed system, and a slit extending inwardly from an edge of the recess which engages a knife edge of the male guide.

2. The stack of paper as claimed in claim 1, wherein the slit extends substantially perpendicular to the opposite side edges of the sheet of paper.

3. The stack of paper as claimed in claim 1, wherein the slit extends from an innermost edge of the recess.

4. The stack of paper as claimed in claim 1, wherein the slit comprises a rectangular shape.

5. The stack of paper as claimed in claim 1, wherein the slit comprises a V-shape.

6. The stack of paper as claimed in claim 1, wherein the recess comprises a semicircular shape.

7. The stack of paper as claimed in claim 1, wherein the recess is a first recess, wherein each sheet of paper further comprises a second recess, and wherein the first and second recesses are formed the opposite side edges of the sheet of paper.

* * * * *